US007235025B2

(12) United States Patent
Quinn

(10) Patent No.: US 7,235,025 B2
(45) Date of Patent: Jun. 26, 2007

(54) SPORTS GOAL HAVING CURVILINEAR FRAME SECTION

(75) Inventor: Lawrence Quinn, Buffalo, NY (US)

(73) Assignee: Hockey Western New York, LLC, Buffalo, NY (US)

( * ) Notice: Subject to any disclaimer, the term of this patent is extended or adjusted under 35 U.S.C. 154(b) by 0 days.

(21) Appl. No.: 11/106,250

(22) Filed: Apr. 14, 2005

(65) Prior Publication Data

US 2006/0232013 A1 Oct. 19, 2006

(51) Int. Cl.
*A63B 63/00* (2006.01)

(52) U.S. Cl. ..... 473/478; 273/127 R; 273/400

(58) Field of Classification Search ..... 273/398–402, 273/127 R, 127 B; 473/476, 478
See application file for complete search history.

(56) References Cited

U.S. PATENT DOCUMENTS

| | | | | | |
|---|---|---|---|---|---|
| 2,077,343 | A | * | 4/1937 | Oakes et al. | 473/478 |
| 3,955,815 | A | | 5/1976 | Deschesnes | |
| 3,979,120 | A | | 9/1976 | Dietrich et al. | |
| 4,245,843 | A | | 1/1981 | Griggs | |
| 4,619,456 | A | | 10/1986 | Meggs | |
| 4,664,384 | A | | 5/1987 | Solla | |
| 4,721,306 | A | | 1/1988 | Shewchuk | |
| 5,039,100 | A | | 8/1991 | Cortese | |
| 5,346,227 | A | * | 9/1994 | Amram et al. | 273/400 |
| 5,427,381 | A | * | 6/1995 | Macaluso et al. | 273/400 |
| 5,433,433 | A | * | 7/1995 | Armell | 473/478 |
| 5,449,170 | A | | 9/1995 | Clements | |
| D368,500 | S | | 4/1996 | Parzino | |
| 5,527,185 | A | | 6/1996 | Davis | |
| 5,533,733 | A | | 7/1996 | Dirnbeck | |
| 5,564,711 | A | | 10/1996 | Scheie | |
| 5,580,064 | A | | 12/1996 | Childers, Jr. | |
| D377,673 | S | | 1/1997 | Henrickson | |
| 5,772,537 | A | * | 6/1998 | Anderson et al. | 473/435 |
| 5,800,312 | A | | 9/1998 | Ormondroyd | |
| 5,820,497 | A | | 10/1998 | Pena | |
| 5,823,885 | A | * | 10/1998 | Stempfer | 473/197 |
| 6,030,301 | A | | 2/2000 | Asada et al. | |
| 6,070,879 | A | | 6/2000 | Kemp | |
| 6,142,892 | A | | 11/2000 | Dennis | |
| 6,190,272 | B1 | * | 2/2001 | Bernard | 473/471 |
| 6,261,196 | B1 | | 7/2001 | Caruso | |
| 6,264,572 | B1 | | 7/2001 | Matheson et al. | |

(Continued)

OTHER PUBLICATIONS www.buffalonews.com/editorial/20050331/1051316.asp, "Reshaping hockey's future" by Tim Graham News Sports Reporter, Mar. 31, 2005.

(Continued)

*Primary Examiner*—Mark S. Graham
(74) *Attorney, Agent, or Firm*—Harter Secrest & Emery LLP; Brian B. Shaw, Esq.; Thomas B. Ryan, Esq.

(57) ABSTRACT

A sports goal is provided having a pair of vertically extending posts and an interconnecting cross bar, wherein at least one of the posts and the cross bar include a curvilinear section. The posts extend from bottom ends adjacent a playing surface to upper ends interconnected with the cross bar, wherein the bottom ends of the posts and the junctions with the cross bar are located at the vertices of a rectangle.

10 Claims, 9 Drawing Sheets

U.S. PATENT DOCUMENTS

| | | | | |
|---|---|---|---|---|
| 6,299,554 | B1 * | 10/2001 | Sinclair et al. | 473/435 |
| 6,311,857 | B1 | 11/2001 | Darraji | |
| 6,517,444 | B1 * | 2/2003 | Yoon | 473/197 |
| 6,530,844 | B2 * | 3/2003 | Lin | 473/197 |
| 6,695,724 | B2 | 2/2004 | Birss | |
| 6,881,154 | B2 * | 4/2005 | Neskudla et al. | 473/197 |
| 2004/0116215 | A1 * | 6/2004 | Fobean et al. | 473/478 |
| 2005/0054464 | A1 * | 3/2005 | Bryant et al. | 473/478 |

OTHER PUBLICATIONS www.tsn.ca/nhl/news_story.asp?id=119826, "NHL considering bigger nets" by TSN.ca Staff, Mar. 29, 2005.

* cited by examiner

FIGURE 7a
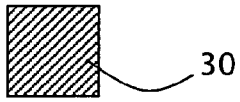
FIGURE 7b
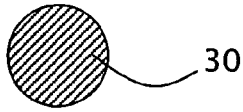
FIGURE 7c
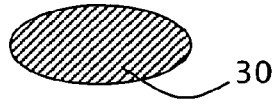
FIGURE 7d
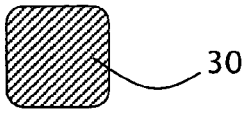
FIGURE 7e
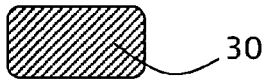
FIGURE 7f
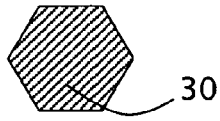
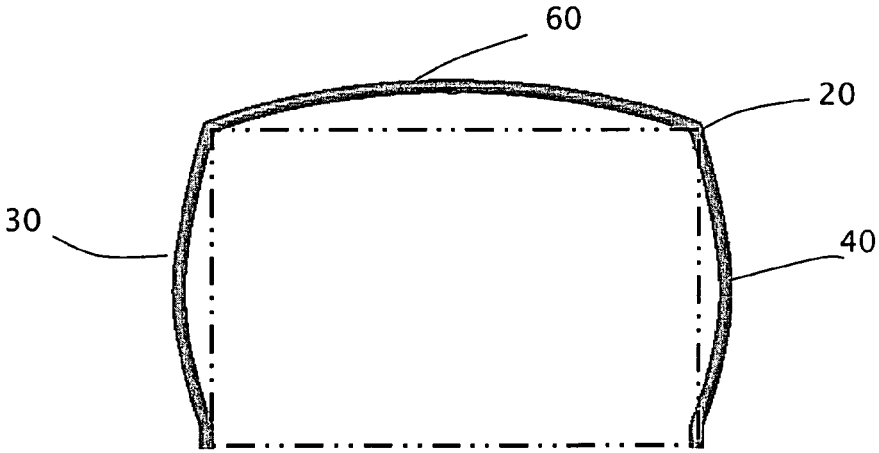
FIGURE 8

FIGURE 26
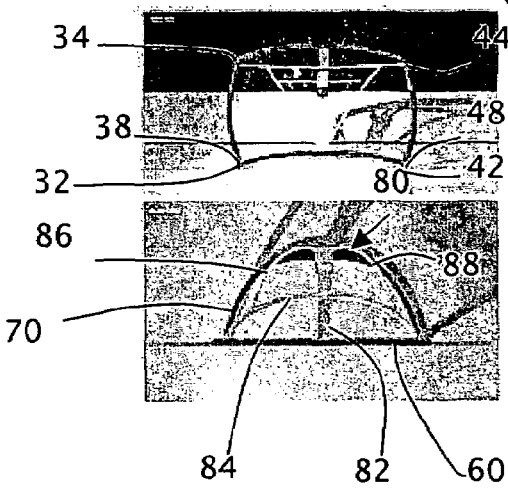
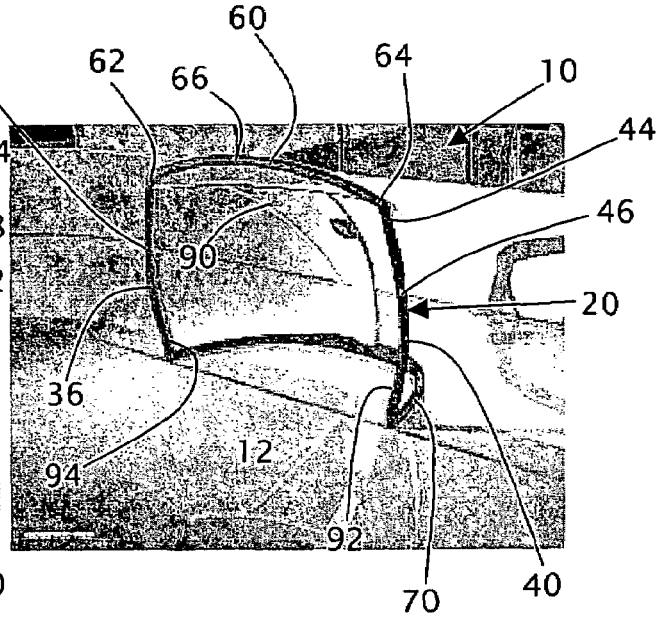
FIGURE 27
FIGURE 25

SPORTS GOAL HAVING CURVILINEAR FRAME SECTION

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present invention relates to sports goals, and more particularly, to a sports goal for cooperating with a playing surface, wherein the sports goal has a curvilinear portion for enhancing scoring opportunities.

2. Description of Related Art

Sports goals have traditionally been formed of a rectangular frame with a net connected to the frame to capture an object passing through the frame. Such representative goals include soccer, hockey, water polo, lacrosse as well as handball.

Many sports have found increased fan appreciation, when scoring increases. However, changes to rules regulating play are typically required to provide for such increases in scoring, and rule changes are often met with fan and participant resistance. Further, new rules often leads to inconsistent interpretation and application which can lead to fan dissatisfaction and participant frustration.

In hockey, the scoring average has actually decreased over the past years, as goalies are now physically larger than their earlier counterparts and equipment, such as pads, has become lighter and larger. The decreased scoring has been attributed as a source of some fan dissatisfaction.

Therefore, the need exists for allowing increased scoring opportunities, without changing fundamental aspects of a given sport. The need also exists for a sports goal that will not significantly disadvantage either the offense or defense, and particularly a goalie.

BRIEF SUMMARY OF THE INVENTION

The present sports goal provides a goal configuration for allowing increased scoring opportunities, while maintaining fundamental aspects of the goal. Further, the present invention does not require a reduction in goaltender padding or equipment, wherein such reduction can cause goaltender unease.

In one configuration, the present goal includes a frame cooperating with a playing surface, wherein the frame has three sides with at least one of the sides including a curvilinear section and the frame intersects four vertices of a rectangle. In a further configuration, the rectangle as a height of approximately 4 feet and a length of approximately 6 feet.

It is further contemplated that the frame lies in a common plane, and the three sides can include a pair of spaced apart posts (uprights) and an interconnecting cross bar, wherein each of the sides includes a curvilinear section. The curvilinear section can extend convex relative to the aperture of the goal, thereby increasing the area of the goal as compared to the rectangle.

The invention will be understood more easily and other objects, characteristics, details and advantages thereof will become more clearly apparent in the course of the following explanatory description, which is given, without in any way implying a limitation, with reference to the attached Figures. It is intended that all such additional systems, methods features and advantages be included within this description, be within the scope of the present invention, and be protected by the accompanying claims.

BRIEF DESCRIPTION OF THE SEVERAL VIEWS OF THE DRAWING(S)

FIGS. 7A–7*f* are cross-sectional views of a representative posts or cross bars.

FIG. 8 is an overlay of the present sports goal with respect to a rectangle.

Figure 2:
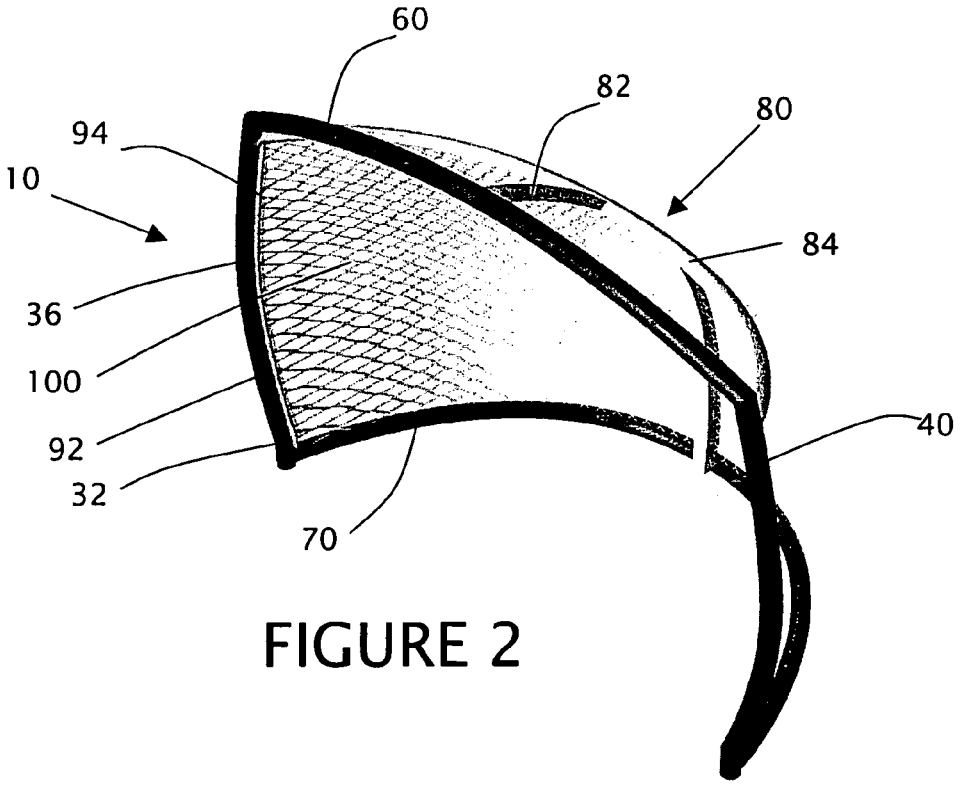
FIG. 2 is a right front upper perspective view of the goal of FIG. 1.
Figure 5:
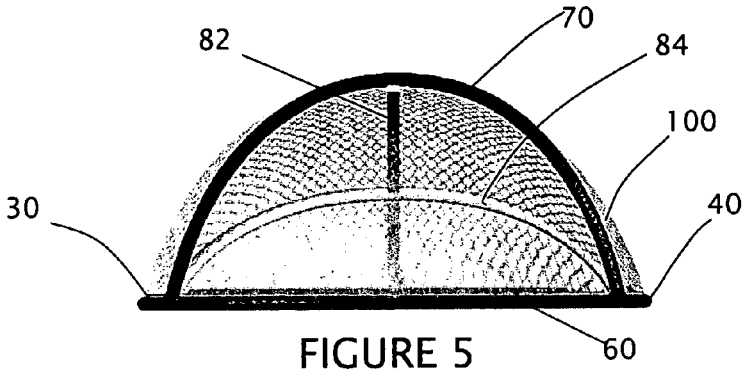
FIG. 5 is a top plan view of the sports goal of FIG. 2.
Figure 3:
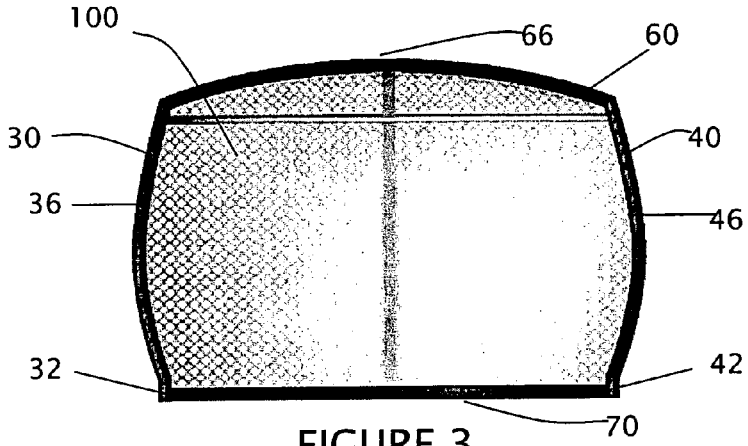
FIG. 3 is a front elevational view of the sports goal of FIG. 2.
Figure 9:
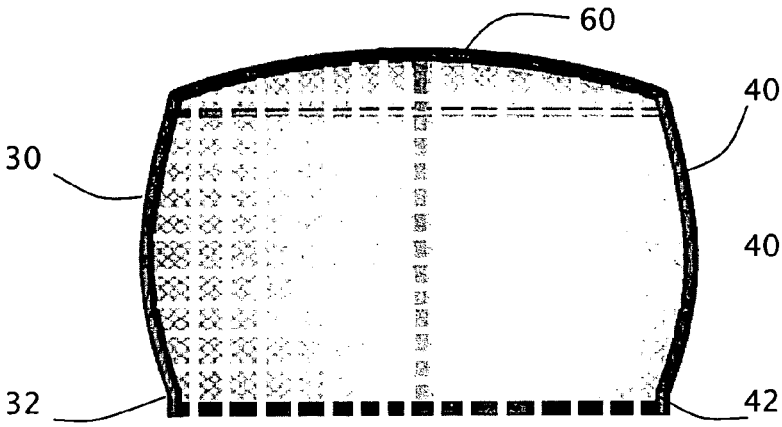

FIG. 9 is a front elevational view of the sports goal of FIG. 2 with the net, net supports and base shown in phantom.

Figure 10:
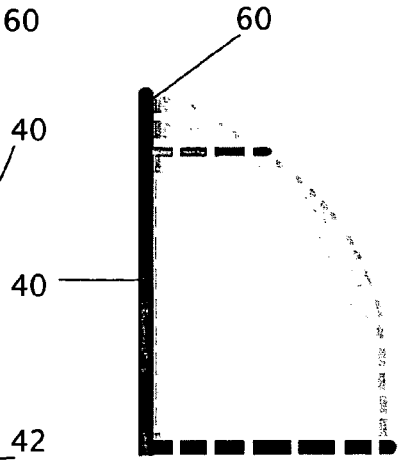

FIG. 10 is a left side elevational view of the sports goal of FIG. 9, wherein a right side elevational view is a mirror image thereof.

Figure 11:
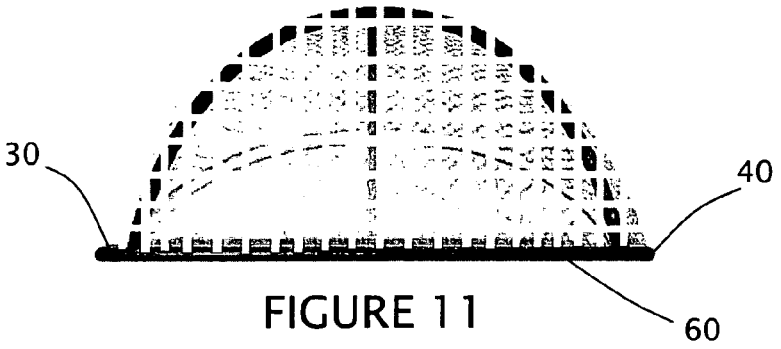

FIG. 11 is a top plan view of the sports goal of FIG. 9.

Figure 12:
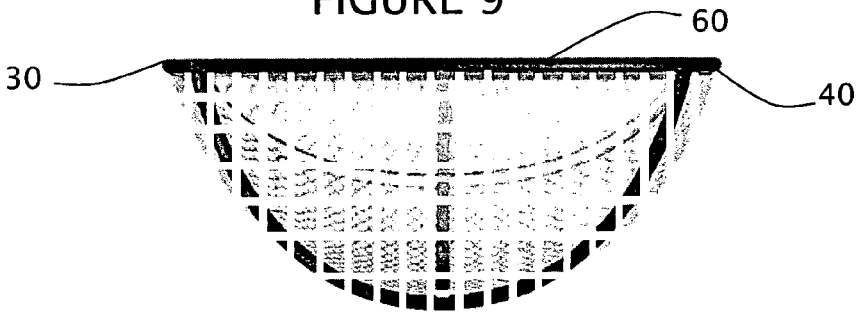

FIG. 12 is a bottom plan view of the sports goal of FIG. 9.

Figure 13:
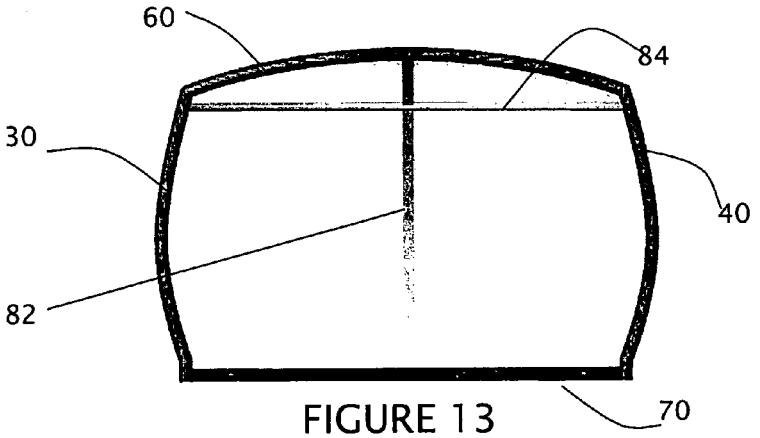

FIG. 13 is a front elevational view of the sports goal of FIG. 2, with the net removed.

Figure 14:
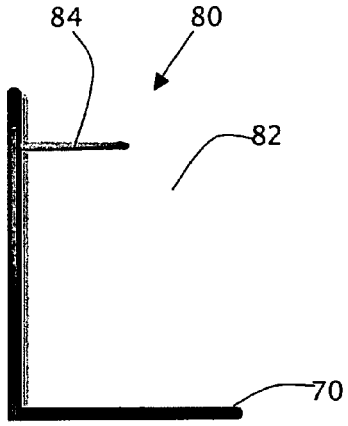

FIG. 14 is a left side elevational view of the sports goal of FIG. 13, wherein a right side elevational view is a mirror image thereof.

Figure 15:
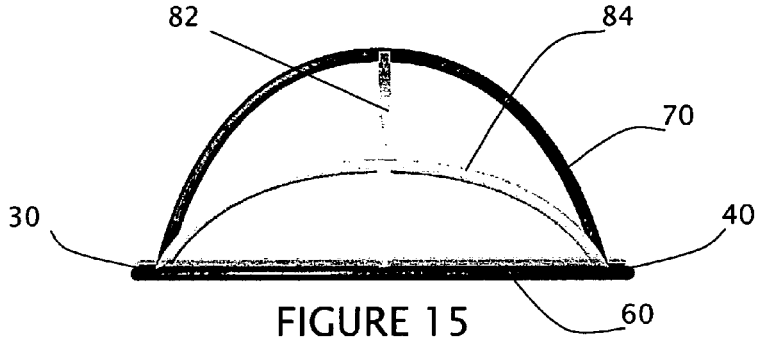

FIG. 15 is a top plan view of the sports goal of FIG. 13.

Figure 16:
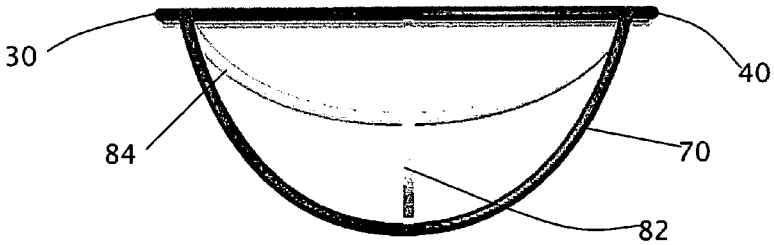

FIG. 16 is a bottom plan view of the sports goal of FIG. 13.

Figure 17:
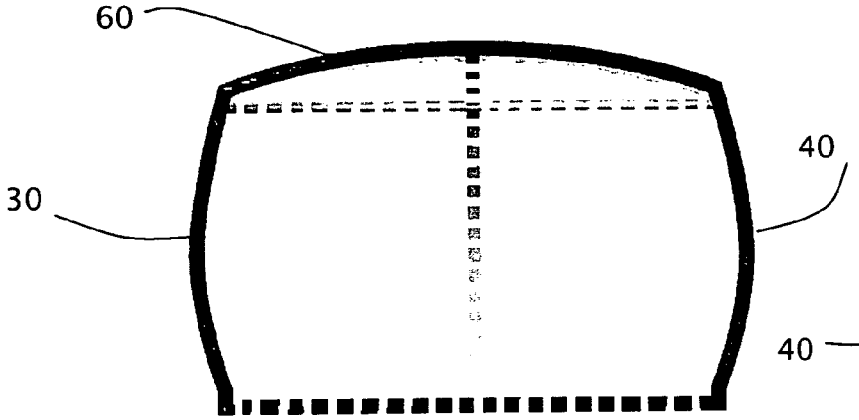

FIG. 17 is a front elevational view of the sports goal of FIG. 13, with the net supports and base shown in phantom.

Figure 18:
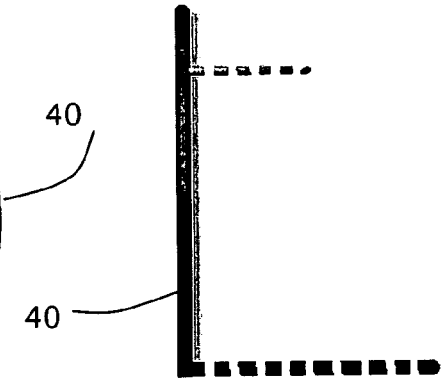

FIG. 18 is a left side elevational view of the sports goal of FIG. 13, wherein a right side elevational view is a mirror image thereof.

Figure 19:
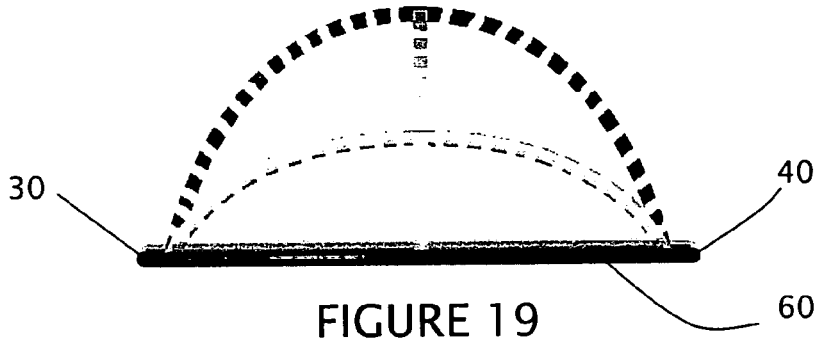

FIG. 19 is a top plan view of the sports goal of FIG. 13.

Figure 20:
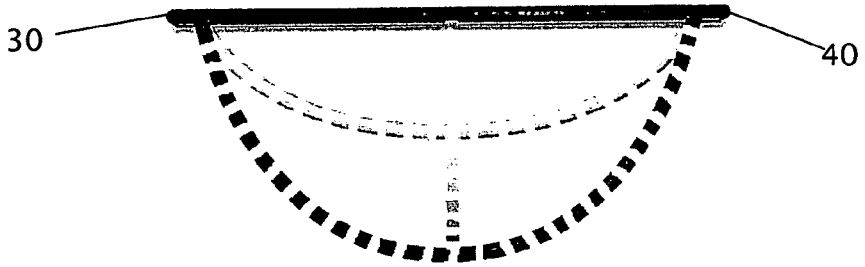

FIG. 20 is a bottom plan view of the sports goal of FIG. 13.

Figure 21:
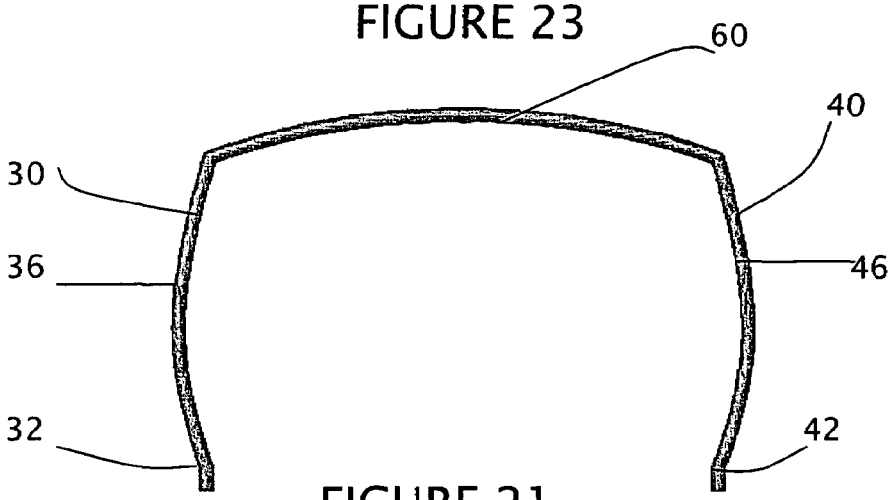

FIG. 21 is a front elevational view of the frame for a sports goal.

Figure 22:
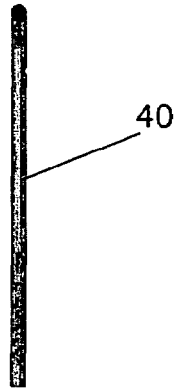

FIG. 22 is a left side elevational view of the frame for the sports goal of FIG. 21, wherein a right side elevational view is a mirror image thereof.

Figure 23:
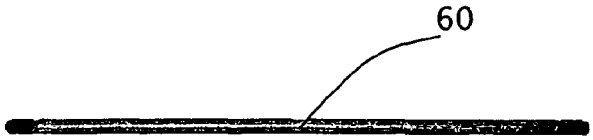

FIG. 23 is a top plan view of the frame for the sports goal of FIG. 21.

Figure 24:
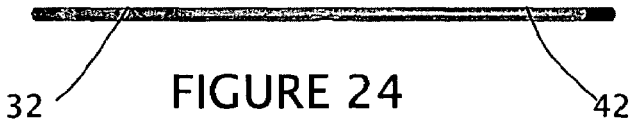

FIG. 24 is a bottom plan view of the frame for the sports goal of FIG. 21.

FIG. 25 is a right front upper perspective view of a sports goal with an alternative net support configuration, with the net removed.

FIG. 26 is a front elevational view of the sports goal of FIG. 25.

FIG. 27 is a top plan view of the sports goal of FIG. 25.

Figure 28:
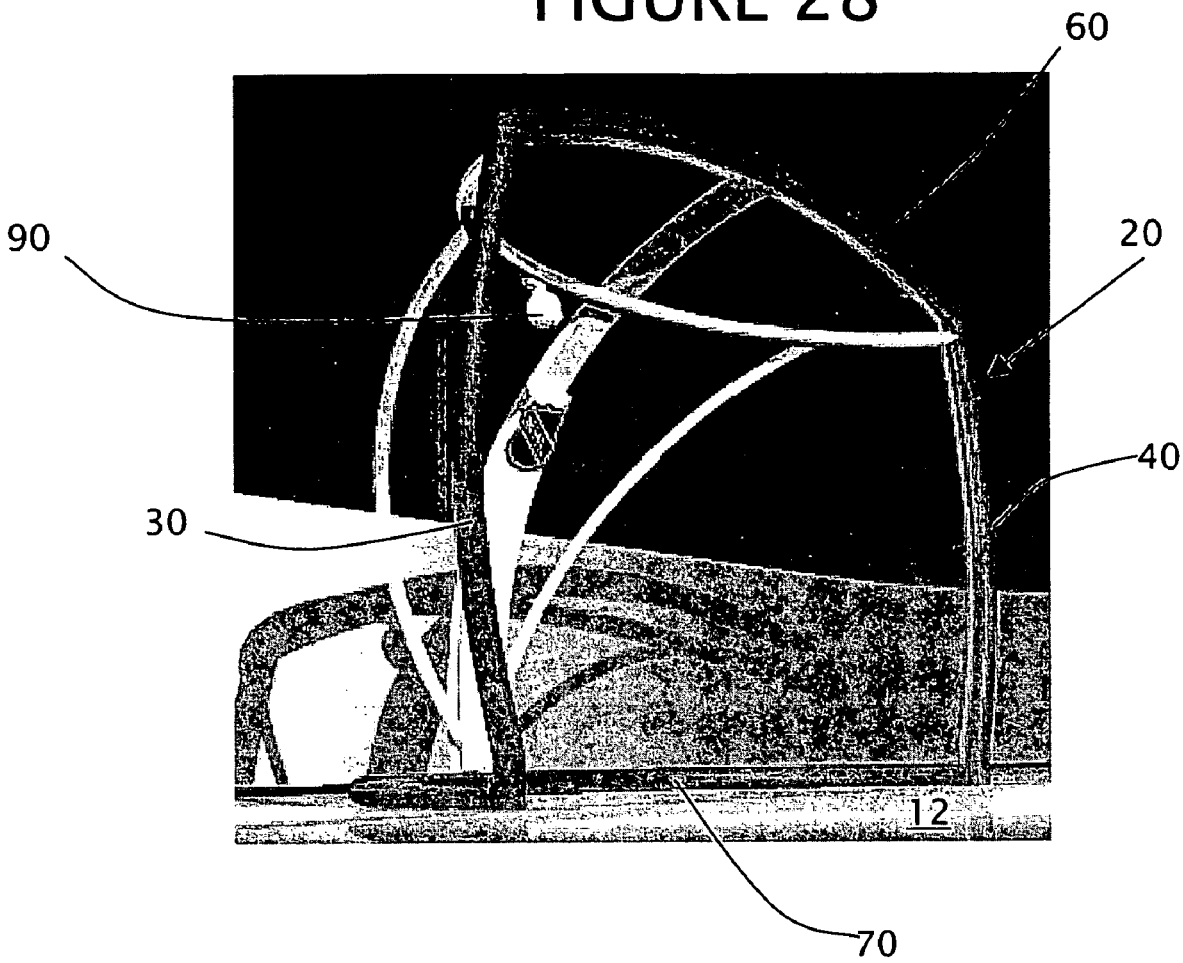

FIG. 28 is a left front lower perspective view of the sports goal of FIG. 25.

DETAILED DESCRIPTION OF THE INVENTION

Figure 1:
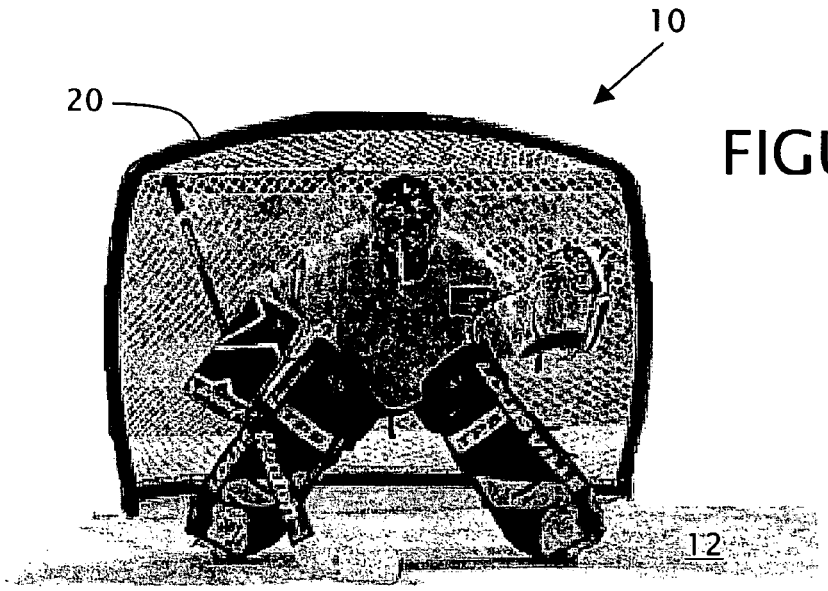
FIG. 1 is a front elevational view of a configuration of the present goal, with a representative goalie.

Referring to FIG. 1, the present sports goal 10 includes a frame 20, wherein a net 100 can be connected to the frame to capture scoring objects. The frame 20, typically in conjunction with a playing surface 12, defines an aperture through which an object must pass to achieve a score in the sport.

Although the present sports goal 10 can be employed in any of a variety of sports which employ a goal, for purposes of the present description, the sports goal is set forth in the configuration of a hockey goal. Similarly, the playing surface 12 can be any of the variety of surfaces, such as grass, clay, turf, wood, polymeric, water or ice. For purposes of the present description, and without limiting the invention in any way, the playing surface 12 may be referred to as ice.

Pursuant to the current NHL Rulebook, goal posts shall extend vertically 4 feet above the surface of the ice and set 6 feet apart measured from the inside of the posts. A cross bar of the same material as the goalposts shall extend from the top of one post to the top of the other. (NHL Rulebook, Rule 3(b)). A net shall be attached to each goal frame, the net made of a white nylon cord which shall be draped in such a manner as to prevent the puck coming to rest on the outside of it yet strung in a manner that will keep the puck in the net. (NHL Rulebook, Rule 3(c)).

Thus, the traditional goal is in the form of a rectangle having a 4 foot height and 6 foot length, wherein the posts and the cross bar intersect at right angles at a vertex of the rectangle. Lower or bottom ends of the posts are spaced 6 feet apart and project at right angles to the surface of the ice.

The present goal 10 includes three sides, presently set forth as a pair of upwardly projecting posts 30, 40 and a cross bar 60. Each post 30, 40 includes a bottom end 32, 42 and a top end 34, 44 respectively, wherein the bottom end is adjacent the playing surface 12 (ice) and the top end is spaced from the playing surface. The cross bar 60 includes a first end 62 and a second end 64, wherein the first end is connected to the top end 32 of one post 30 and the second end is connected to the top end 42 of the remaining post 40.

As seen in FIGS. *7a–7f*, the posts 30, 40 and cross bar 60 can be defined by any of a variety of cross sections. That is, the posts 30, 40 and cross bar 60 can be tubular members or solid members having a circular, oval, obround, triangular, square rectangular curvilinear or faceted cross section. It is also contemplated that the cross section of the posts 30, 40 can be the same or different than the cross section of the cross bar 60.

In one configuration, the bottom end 32, 42 of the posts 30, 40 and the top end 34, 44 of the posts are spaced 6 feet apart and the cross bar 60 extends between the top end of the posts. The top end 32, 42 of the posts 30, 40 are spaced to 4 feet from the plane of the playing surface 12.

At least one of the posts 30, 40 and the cross bar 60 includes a curvilinear section. It is contemplated that one, or both the posts 30, 40 can include a corresponding curvilinear section 36, 46 both posts and the cross bar can include a curvilinear section, the cross bar 60 includes a curvilinear section 66, or one of the posts and the cross bar include a curvilinear section.

The term "curvilinear" encompasses a length formed bounded or characterized by a curved line. That is, a line that deviates from straightness.

The curve defined by the curvilinear section 36, 46, 66 of the respective post 30, 40 and cross bar 60 can be the same curve or a different curve. For example, the curvilinear section 36, 46 of the posts 30, 40 can be defined by a radius of curvature of approximately 97 inches and the curvilinear section 66 of the cross bar 60 can be defined by a radius of curvature of approximately 111 inches. It is further contemplated the curvilinear section can be defined by any of a number of mathematical constructs, such as parabolic, hyperbolic, catenary, elliptical, oval as well as semicircular.

The curvilinear section 36, 46, 66 of the posts 30, 40 and cross bar 60 respectively can extend to the intersection of the cross bar and the posts, such that the intersection represents a discontinuity in the respective curvilinear section. That is, the intersection of the top end 34, 44 of the posts 30, 40 and the cross bar 60 is not mathematically continuous to the curvilinear portions of both the posts and the cross bar. However, it is understood, a sufficiently high order equation may at least approximate the intersection of the posts 30, 40 and the cross bar. Typically the curvilinear section 36, 46 of the post is discontinuous with the curvilinear section 66 of the cross bar 60.

The curvilinear section 36, 46 of the posts 30, 40 can be substantially similar, while the curvilinear section 66 of the cross bar 60 can have a different curvilinearity.

The aesthetic appeal of the goal 10 can also be a factor, in conjunction with the desired increase in the area of the goal, while in determining the curvilinear nature of the respective post 30, 40 or the cross bar 60.

Although the curvilinear section of the respective portion of the frame 20 can extend toward the opposing post (for a curvilinear section 36, 46 in the post 30, 40) or toward the playing surface 12 (for the curvilinear section 66 in the cross bar 60), a satisfactory direction of curvature for the posts is convex with respect to the remaining post and the center of the radius of curvature for the cross bar is located below the cross bar.

In one configuration, each of the posts 30, 40 and the cross bar 60, including the respective curvilinear sections 36, 46, 66 are disposed in a common plane. That is, such frame 20 lies in a single plane.

Referring to FIG. 8, the vertices of the traditional goal (hockey, soccer, lacrosse) shown in the dashed line are common to the intersection of the present sides (which incorporate the curvilinear portions) of the present goal 10. That is, the bottom ends 32, 42 of the posts 30, 40 are at same locations as the bottom ends of current hockey goals. Similarly, the intersection of the posts 30, 40 with the cross bar 60 are at the same locations as the intersection of the posts and the cross bar in current hockey goals. The distance between the top end 34, 44 of the posts 30, 40is the same as the distance between the bottom end 32, 42 of the posts. Therefore, in the hockey configuration, the distance between the bottom ends 32, 42 of the posts 30, 40 is six feet and the distance between the top end 34, 44 of the posts is also six feet.

The posts 30, 40 can be fixed relative to the playing surface 12 (ice) by any of a variety of coupler mechanisms. For example, installation can be accomplished by a removable stub uprights (not shown) sticking upwardly out of the ice at the desired positions of the posts 30, 40 and the posts are hollow with an open bottom end 32, 42 so that the posts can fit over the upwardly projecting stub uprights. Thus, when the ice is to be used for activities other than hockey games, or the ice is to be refinished, the goal 10 is removed and the stub uprights can be removed from the ice. While use of the stub uprights in conjunction with the hollow posts produces a hockey goal which is firmly anchored in position, the anchoring of the goal typically remains in tact even upon impact with a player.

Thus, in an alternative coupler configuration, the posts 30, 40 can be magnetically retained such as by employing a keeper which is fixed to the ice and includes an upwardly projecting frustoconical central portion having a ferromagnetic core. The posts 30, 40 are sized to receive a cylindrical canister, wherein the cylindrical canister includes means defining a ferromagnetic flux path within the canister and adapted to contact the frustoconical keeper, such as shown in U.S. Pat. No. 4,619,456, herein expressly incorporated by reference.

It is contemplated that other breakaway coupler systems can be employed for retaining the goal 10. For example, those shown in U.S. Pat. No. 5,039,100 issued to Cortese, U.S. Pat. No. 4,721,306 issued to Shewchuk; U.S. Pat. No. 4,619,456 issued to Meggs or U.S. Pat. No. 3,979,120 issued to Dietrich, each of which is hereby expressly incorporated by reference. A further breakaway coupler system includes a flexible rubber-like stub upright received into a hollow portion of the corresponding post 30, 40. Upon impact loading, the flexible stub upright bends, thereby allowing the goal 10 to ride up the upright, and upon removing the impact loading, the goal slides back down the uprights and returns to the operable position.

Referring to at least FIGS. 1–3, 9, 13 and 17, in one configuration, the posts 30, 40 each include a linear section 38, 48 as well as the curvilinear section 36, 46. In this configuration, each of the posts 30, 40 extends adjacent the playing surface 12 (ice), wherein the linear section 38, 48 is sized to receive the coupler for retaining the goal in operable position. Typically, the linear section extends 38, 48 from the bottom end 32, 42 of the posts 30, 40 to a height between approximately one to three inches from the lower end and hence the playing surface 12.

In one configuration, the posts 30, 40 extend upward from the linear section 38, 48 along the curvilinear section 36, 46 to terminate four feet above the playing surface 12, directly above the linear section. The amount of bow or radius of curvature of the curvilinear section 36, 46 can be selected depending upon the desired increase in goal size. A satisfactory curvilinear portion has been found to be defined by a deflection of approximately 3 inches from a vertical line extending from the linear section 38, 48 of the post 30, 40 to the intersection or junction of the post and the cross bar 60.

The maximum deviation from vertical along the height of the post 30, 40 can be generally symmetrically disposed with respect to the height of the post. However, it is contemplated the maximum deflection can be asymmetric with respect to the height of the post 30, 40. That is, the portion of maximum deviation from a vertical can be located nearer to the cross bar 60, or nearer to the playing surface 12.

The deviation of the cross bar 60 from horizontal can be selected depending upon the desired increase in goal size. A satisfactory curvilinear section 66 has been found to be defined by a deflection of approximately 6 inches from horizontal. The maximum deviation from horizontal along the width of the cross bar 60 can be generally symmetrical between the posts 30, 40. However, it is contemplated the maximum deflection can be asymmetric with respect to the width of the cross bar 60.

A further satisfactory configuration of the cross bar 60 includes a substantially continuously curvilinear length between the ends 62, 64 of the cross bar. However, it is contemplated the cross bar 60 can include a linear section intermediate spaced apart curvilinear sections or adjacent to the posts 30, 40.

The present frame 20 can increase the effective area of the goal 10 by as little as 1 or 2%, to as much as 25 to 30%. One satisfactory increase in area has been found to be on the order of (10% to 18% with a satisfactory increase of approximately 14%).

Figure 4:
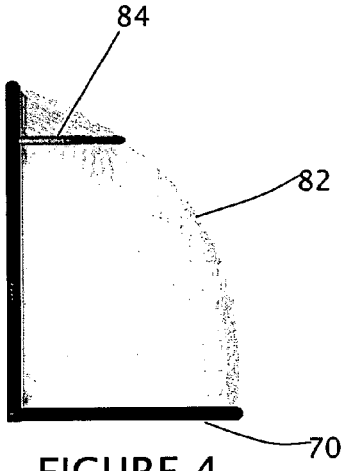
FIG. 4 is a left side elevational view of the sports goal of FIG. 2, wherein a right side elevational view is a mirror image thereof.
Figure 6:
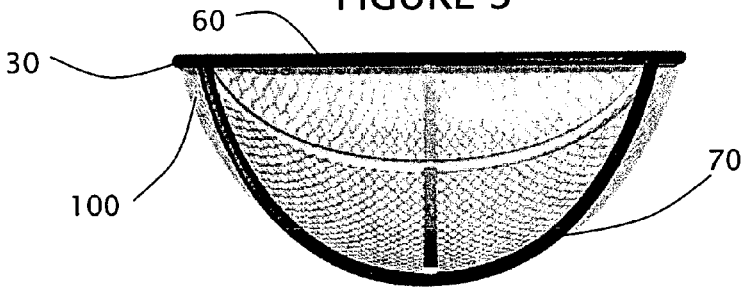
FIG. 6 is a bottom plan view of the sports goal of FIG. 2.

As seen in the Figures, particularly FIGS. 4 and 14, a base 70 can extend between the bottom ends 32, 42 of the posts 30, 40 in a plane that extends at right angles to the plane of the posts and cross bar 60. The base 70 extends rearward from the posts 30, 40 to generally define the back of the goal 10. As seen in FIGS. 5, 6, 15 and 16, the base 70 is substantially curvilinear or C-shaped. However, it is contemplated the base 70 can include a linear section along the rear most section of the base.

The base 70 can extend behind the plane of the frame 20 by approximately 3 feet. However, it is understood the base can extend to the traditional 44 inch depth.

In contrast to existing designs in which the base has a greater width than the distance between the posts, one configuration of the base 70 can extend as a generally convex shape extending rearward from the posts 30, 40 and thus does not extend beyond the spacing of the posts, as seen in at least FIGS. 5, 6, 15 and 16. However, it is understood the base 70 can extend to larger dimension than the spacing between the posts 30, 40, similar to the flare of a traditional hockey goal.

The base 70 can have a larger cross-section than the posts 30, 40 or the cross bar 60, wherein the cross-section of the base can be selected to retain a power supply such as a battery pack. Thus, the goal 10 can include a power supply for operating selected devices.

Alternatively, the base 70 can be defined by two curves having spaced apart centers of curvature, wherein the two curves generally define a kidney shape. Again, the base 70 can be narrower than, wider than or substantially equal to the width of the goal 10.

Any of a variety of net supports 80 can extend between the base 70, the posts 30, 40 and the cross bar 60. The net supports 80 are selected to comply with applicable rules such as maintaining a drape of the net in a manner as to prevent the puck from coming to rest on the outside of the net 100, while keeping the puck in the net.

As seen in the FIGS. 2–6 and 13–16, a main net support 82 extends from the back of the base 70 upward to the center of the cross bar 60 in a generally curvilinear profile. A transverse net 84 support extends from the main net support 82 to connect to each of the posts 30, 40, or the junction of the respective post and the cross bar 60. In a further configuration, shown in FIGS. 25–28, a pair of secondary net supports 86, 88 can extend from the base 70 adjacent the main net support 82 or from a lower end of the main net support 82 to the transverse net support 84.

The net supports 80 can thus be configured to provide any of a variety of profiles of the net 100. Further, the respective components of the net supports 80 can have different sizes, cross sections and profiles. For example, as seen in the Figures, the main net support 82 has a generally rectangular cross section, while the secondary supports 86, 88 and the transverse net support 84 have a generally circular cross-section. The rectangular cross-section of the main net support 82 can be selected to bear the team, league or sponsorship logo.

In addition, the net supports 80 can be configured to retain a camera 90. The camera 90 can be affixed to one of the net supports 80 by a coupling. Alternatively, one of the net supports 80 can have a cross-section sized to substantially receive the camera 90. The camera 90 can be operably connected to the batteries located in the base 70, for providing power to the camera.

It is further contemplated that sensors 92 can be incorporated into the frame 20 for determining or assisting a determination of puck location, such as in evaluating whether a goal has been scored. The sensors 92 can be operably connected to the batteries 70 in the base, for providing power to the sensors. The sensors can be optical, ultrasonic, electromagnetic or electrical and are configured to determine or assist in determining the presence of a puck relative to a goal line.

Similarly, the frame 20 can include a goal light indication system which includes an elongate light emitting or light generating and emitting element 94, such as a light line or fiber-optic, or a side emitting fiber-optic extending along a portion of one of the posts 30, 40 or the cross bar 60. Thus, in one configuration, upon the scoring of a goal, the periphery of the frame 20 is illuminated by the light element 94.

In a further configuration, it is contemplated at least one of the sides can deviate from a straight line by employing a linear section in conjunction with the curvilinear section or a plurality of linear sections that either intersect or a parallel (but not collinear) with the traditional post. That is, at least one of the posts 30, 40 and the cross bar 60 can includes a curvilinear section as well as a linear sections or just linear sections, wherein the linear sections intersect, within the length of the post or cross bar.

While the invention has been described in connection with a presently preferred embodiment thereof, those skilled in the art will recognize that many modifications and changes can be made without departing from the true spirit and scope of the invention, which accordingly is intended to be defined solely by the appended claims.

The invention claimed is:

1. A sports goal comprising:

a fixed frame having three sides in a common plane, the frame intersecting four vertices of a rectangle, wherein at least one of the sides includes a curvilinear length extending along a majority of the at least one side, the three sides including a pair of uprights and a cross bar, ends of the uprights and ends of the cross bar being located at the vertices of the rectangle;

a self supporting base extending from a bottom end of each upright, the base lying in a plane perpendicular to the uprights and interconnecting the uprights;

a net connected to the frame and the base;

a main net support extending from the base to the cross bar and a transverse net support extending transverse to the main net support, the main net support and the transverse net support spacing the net from the common plane.

2. The sports goal of claim 1, wherein each side terminates at corresponding ends, and at least one of the sides is bowed intermediate the ends.

3. The sports goal of claim 1, further comprising a mount connected to a playing surface, wherein two of the sides include a coupler releasably engaging the mount.

4. The sports goal of claim 1, wherein two of the sides include a linear section and a curvilinear section.

5. The sports goal of claim 1, wherein the rectangle has a height of approximately 4 feet and a width of approximately 6 feet.

6. The sports goal of claim 1, wherein each of the three sides includes a curvilinear section.

7. A sports goal comprising:

a planar fixed frame having a pair of spaced uprights and a cross bar interconnecting the uprights, the frame intersecting vertices of a rectangle, wherein at least one of the uprights and the cross bar include a curvilinear length extending along substantially the entire one of the uprights and the cross bar, the frame defining a goal opening;

a base extending perpendicular from each upright and interconnecting the uprights;

a net connected to the frame and the base; and a net support connected to the frame and the base, the net support including a main net support and a transverse net support, the net support spacing the net from the goal opening.

8. The sports goal of claim 7, wherein each of the uprights includes a lower end and an upper end, the upper end of each upright connected to a cross bar.

9. The sports goal of claim 7, wherein the intersection of the cross bar and at least one of the posts is a discontinuity in the curvilinear section.

10. A sports goal defining a goal relative to a playing surface, the sports goal comprising:

(a) a first and second vertical post located in a common plane;

(b) a cross bar disposed in the common plane and fixedly interconnecting an upper end of the first and the second post, the upper ends of the posts, lower ends of the posts and ends of the cross bar being located at vertices of a rectangle and one of the first post, the second post and the cross bar including a curvilinear section, the curvilinear section defining a majority of a length of the one of the first post, the second post and the cross bar;

(c) a base extending perpendicularly from the lower ends of the posts and interconnecting the posts, the first post, the second post, the cross bar and the playing surface defining an opening of the goal;

(d) a net connected to the first and second vertical post, the cross bar and the base; and (e) a net support connected to at least two of the first and second vertical post, the cross bar and the base, the net support spacing the net from the opening.

* * * * *